United States Patent [19]

Goldfarb

[11] Patent Number: 4,702,140

[45] Date of Patent: Oct. 27, 1987

[54] SOLAR-POWERED MUSICAL ORNAMENTS AND NOVELTIES

[76] Inventor: Adolph E. Goldfarb, 1432 S. East Wind Cir., Westlake Village, Calif. 91361

[21] Appl. No.: 686,664

[22] Filed: Dec. 27, 1984

Related U.S. Application Data

[63] Continuation-in-part of Ser. No. 565,987, Dec. 27, 1983, abandoned.

[51] Int. Cl.[4] ..... G10H 5/04; G10H 7/00

[52] U.S. Cl. ..... 84/1.01; 84/1.18; 84/1.28; 40/906; 446/303

[58] Field of Search ..... 84/1.01, 1.18, 1.28, 84/1.03; 446/303; 428/16; 250/212, 215; 40/906

[56] References Cited

U.S. PATENT DOCUMENTS

| | | | |
|---|---|---|---|
| 4,237,647 | 12/1980 | Shaw | 446/303 |
| 4,314,423 | 2/1982 | Lipsitz et al. | 446/303 |
| 4,376,347 | 3/1986 | Thompson | 40/441 |
| 4,537,109 | 8/1985 | Sakurai | 84/1.18 |

*Primary Examiner*—Arthur T. Grimley
*Assistant Examiner*—David Warren
*Attorney, Agent, or Firm*—Romney Golant Martin Seldon & Ashen

[57] ABSTRACT

These small, inexpensive ornaments and novelties emit music and other sounds (such as simulated voice) when exposed to light, and can be placed out-of-doors in a garden. Being light-powered, they can operate for an essentially indefinite time, even though unattended.

Each such ornament or novelty consists of a thematically configured body and a three-element working module sealed in a watertight can. It has no input keyboard or other terminal, and no display panel or other electronic or visual data output, except the audio output.

Elements are (1) a circuit, preprogrammed to produce electronic oscillations corresponding to a tune or other sounds preestablished at manufacture, (2) a speaker receiving the oscillations and emitting the sounds, and (3) a solar panel powering the circuit. The speaker shuts off if light is inadequate for completely correct operation, and otherwise is amplitude modulated by the light level.

The decorative body, the detailed programming of the circuit, and the particular tune or other sounds are coordinated in theme.

13 Claims, 7 Drawing Figures

SOLAR-POWERED MUSICAL ORNAMENTS AND NOVELTIES

RELATED APPLICATION

This is a continuation-in-part of my application Ser. No. 565,987, filed Dec. 27, 1983, and to be abandoned.

BACKGROUND

1. Field of the Invention

This invention relates generally to microprocessor-operated sound-generating ornaments, novelties and toys, particularly to such items powered by photoelectric cells.

2. Prior Art

Ornaments, novelties, toys and games with digital-logic integrated circuits that excite acoustic speakers are now commonplace. Well-known to electronic technicians and computer programmers are various techniques for causing such circuits to develop a controlled series of electrical oscillations that correspond to musical tunes, or even to more elaborate sounds such as simulated speech. Such oscillations are directed to conventional acoustic speakers, or for small inexpensive applications are directed to ceramic drivers attached to thin metal discs ("benders") which rather reedily convert the electrical oscillations into acoustic vibrations.

With the development of ever-smaller and ever-less-expensive microprocessors, such music or voice simulators have been used in formats that are more and more disposable—as well as tiny. For example, there are now on the market greeting cards that play one or more tunes when opened. All such applications of course require tiny batteries in conjunction with the microprocessors and acoustic converters, and of course become inoperative when the batteries run down.

Also well known are photoelectric cells, commonly termed "solar cells," which generate electricity whenever adequate light impinges upon them. Such cells are now used to develop electrical power for a great variety of purposes. For instance, they are now in general use in commercial public-utility power grids. They are used also to power many different kinds of remote equipment—such as environmental monitoring equipment, complete with digital circuits to preliminarily process the monitoring information and with radio transmitters to report the preliminarily processed information to a base station.

To the best of my knowledge these two areas of modern development have not previously been combined.

SUMMARY OF THE DISCLOSURE

Preferred embodiments of my invention are ornaments and novelties which emit music or other sounds when exposed to light. Each such ornament or novelty includes a body that may be decorative and preferably that is compatible with some distinct theme. For example the body may be in the form of a bird, a butterfly, a flower, a person, or a recognizable article such as a San Francisco cablecar, the Eiffel tower, or an airplane.

Also part of each ornament or novelty, according to certain preferred embodiments of my invention, is a three-element working module sealed in a watertight can.

The three elements are (1) a solid-state digital electronic circuit, programmed to generate a series of electronic oscillations corresponding to a tune or other series of sounds, (2) a small speaker connected to receive the electronic oscillations from the circuit and to emit the corresponding tune or other sounds, and (3) a solar cell connected to power the circuit when exposed to light.

The decorative body, the detailed programming of the circuit, and the particular tune or other sounds are advantageously coordinated in theme. For example, the body may have the shape of a bird, and the circuit may be programmed to emit certain sounds only as the light level increases through a particular range of values. The sounds may be sounds customarily associated with the morning—such as bird-like twitterings, or recognizable melodies such as "Oh What a Beautiful Morning" or "Mockingbird Hill." Such an ornament may be placed in a window or outside in a garden, and will provide the preprogrammed morning sounds only as the sun rises.

Similarly the ornament body may have the shape of a trumpet, and the circuit may be programmed to play "taps" or some other evening song, or to imitate the chirping of crickets, only as the light level decreases through a particular range of values. Thus the ornament will emit these characteristic evening sounds only as the sun sets.

The ornament body may be given a shape thematically related to midday, and the circuit programmed to play a midday song or to emit other midday sounds only when the light level remains generally constant for an extended period. Thus the ornament or novelty may play "Whistle While You Work" only when the sun is near the zenith.

An ornament that has a somewhat neutral shape (such as a bird) may be programmed to perform all of the functions already described, at different times of the day. Alternatively, a much simpler embodiment of the invention may simply emit sounds (such as bird sounds in a garden) constantly whenever there is enough light to operate the circuit and speaker.

On another tack, such articles may be given commercial or political themes and used as promotional novelties. A restaurant chain could give away (or sell at around cost) novelties in the shape of some cartoon character used in the restaurant's television advertising. Near midday (or as the sun sets, for a dinner house) the cartoon-character novelty article could play the restaurant's advertising theme song—and even emit words, such as "It's time for lunch! Come to McDonald's!" The potential for such items extends to airlines, banks, retail stores, political campaigns, and so forth.

Ornaments may also be provided with thematically coordinated bodies and tunes for particular kinds of events, such as birthday parties. Such ornaments may be attached to decorations or food at such special events—particularly when the events are to be held outdoors. As will be apparent, however, some of the benefits of the invention accrue even when the resulting ornaments and novelties are used indoors under artificial lighting—provided that the light level is sufficiently high. In particular, such ornaments may be reused many times for events having similar or related themes, without the need for either power leads or battery replacement.

The working module may also be made with a user-programmable memory (a so-called R. A. M.), and made and sold with a mating input device for easy entering of a particular tune, but without a particular thematic body. Such a module may be made to accept programming for a particular tune by professional caterers or by any musically oriented people preparing for a party or other special event; and may be embedded in a variety of bodies made from papier mache, clay, foodstuffs, etc.—specially shaped for the occasion. Once again, such a module is reusable, with virtually an unlimited life.

Generally the sound level from such devices is relatively low, and consequently is audible only to people who are quite close by. The sound is therefore not so intrusive as to constitute an annoyance, but only a pleasant addition to the surrounds. I have found that when tastefully done, the overall effect produced by such novelties and ornaments is actually quite charming.

The detailed description below, and the drawings, will clarify the principles and advantages of my invention.

DETAILED DESCRIPTION OF PREFERRED EMBODIMENTS

Figure 1:
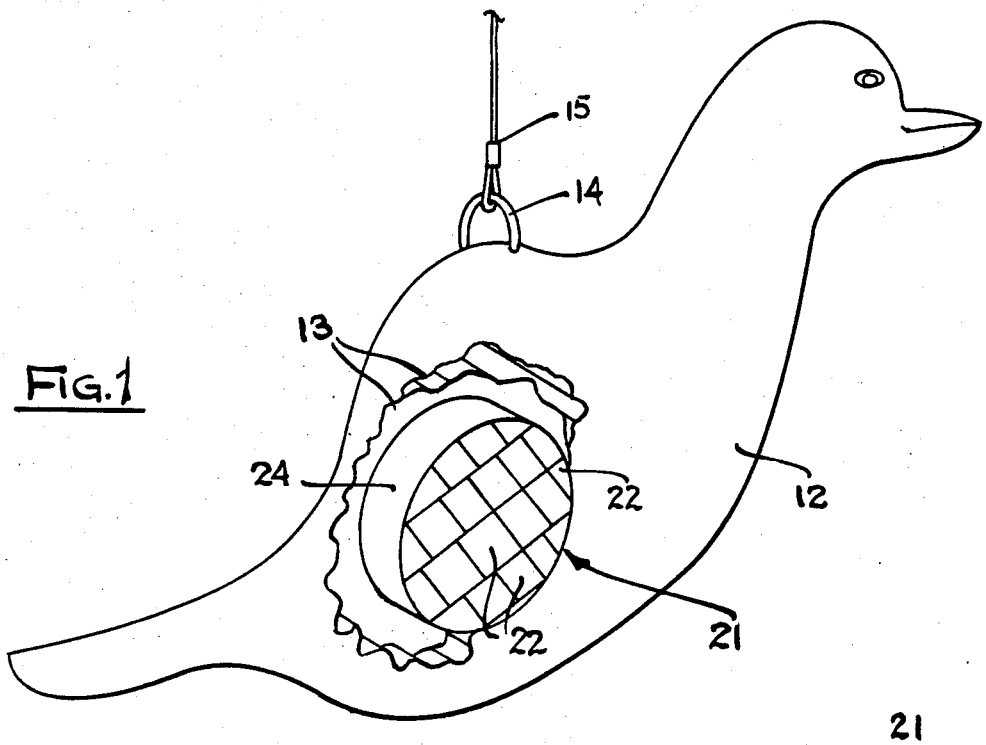
FIG. 1 is a general sketch—broken away to show the module clearly—of one preferred embodiment, to be hung on a cord in a window or from a tree.

FIG. 1 shows an ornament generally having the shape of the body 12 of a creature—perhaps a garden creature such as a snail or a bird—with a working module 21 embedded in the body 12. The ornament also has a hook 14, by which it is attached to a suspending thread or cord 15.

The body is drawn partially broken away as at 13 to show the generally right-circular-cylindrical shape of the working module 21, which has on the visible planar end face a solar cell or an array of solar cells 22. The cylindrical surface 24 of the module 21 is simply a structural member which holds the various pieces of the module together and seals them against the environment.

Figure 2:
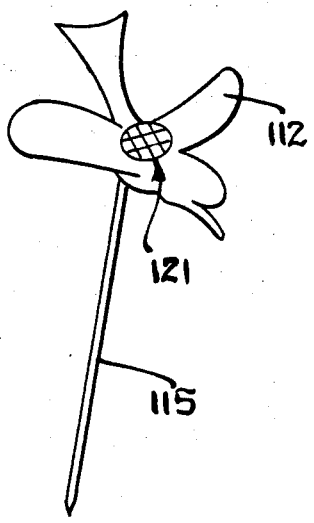
FIG. 2 is a similar sketch of another preferred embodiment, to be staked into the ground as in a garden.

FIG. 2 shows a generally simlar ornament having the shape of a body 112 of a different creature, with a working module 121 similarly embedded in the body 112 and a support member 115. The support 115 may be connected to a pedestal (not illustrated) or may be sharpened at its lower end for insertion as a stake into a relatively soft medium.

The soft medium, into which the support or stake 115 if so sharpened may be pushed, can be soil in the garden. Myriad other uses, however, are contemplated.

For instance, the support 115 may be inserted into a wedding cake for use at a reception—with the body 112 in the form of a bride and groom, and the working module 121 playing a wedding song. Alternatively the support 115 may be inserted into other foods (melons, bread, casseroles, meatloaf, etc.) or into decorative articles at a picnic or other party—and the body 112 may be suitably configured for the event, and the working module 121 programmed to play a suitably selected festive tune.

As previously mentioned, such uses may be "manufactured into" the ornament complete with body theme, or may be left to the imagination and creativity of purchaser-users by providing the working module in programmable form without a body.

Figure 3:
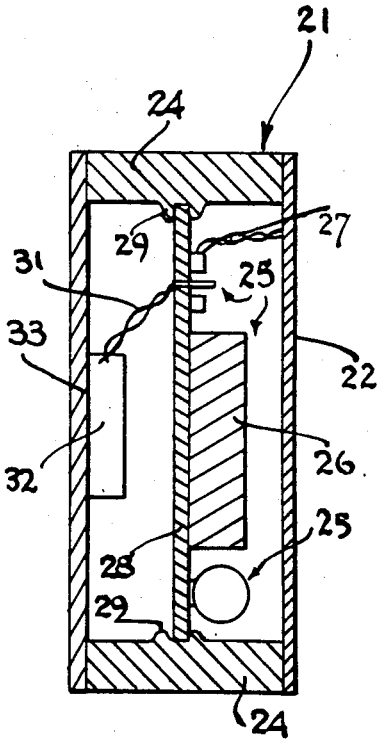
FIG. 3 is a generalized cross-sectional elevation of a module usable with either embodiment, or with others.

FIG. 3 shows the structure of the working module 21 of FIG. 1 (or 121 of FIG. 2). In this cross-sectional elevation through a diameter of the cylindrical working module 21, the solar cell or cells 22 are seen to form one end wall of the cylinder, while the acoustic surface forming the other wall is provided by a metal or ceramic disc 33, to which is internally mounted a piezoelectric or other suitable driver 32.

In the middle of this sandwich is a printed-circuit board 28 carrying various electronic components 25. Prominent among these is a microprocessor and read-only memory (R. O. M.) 26. Interconnecting wires 27 provide power from the solar cell 22 to the circuit elements 25; and like wires 31 provide controlled electrical pulse trains from the circuit elements 25 to excite the acoustic driver 32.

This assemblage is held together and sealed against the environment by a cylindrical can 24, which may be provided with a pair of ridges 29 or a single groove for retention of the printed-circuit board 28—suitable arrangements being made for one-time insertion of the board 28 between the ridges 29 or into the groove.

Figure 4:
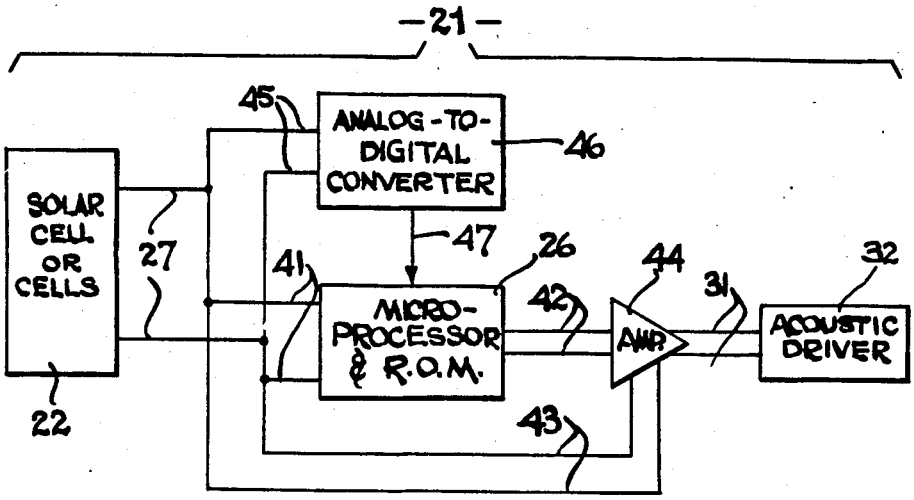
FIG. 4 is an electrical schematic diagram show interconnections between the elements of the FIG. 3 module.

FIG. 4 shows further that the solar cell 22 provides power via leads 27 and 41 to the microprocessor and R. O. M. 26, and via leads 27 and 43 to a buffer or power amplifier 44 (which may be incorporated into the microprocessor and R. O. M. 26). The internally time-structured series of electrical oscillations produced by the microprocessor and R. O. M. 26 passes by leads 42 to the power amplifier 44, whence lower-impedance oscillations of the same time structure pass to the acoustic driver 32.

As previously mentioned the microprocessor and R. O. M. 26 may be replaced by a microprocessor and R. A. M., so that the working module 21 can be made to play various tunes entered by users. For this purpose there should advantageously also be provided a suitable umbilicus (not illustrated) from the microprocessor to an electrical connector at the outside of the working module 21. Such an umbilical connection is preferably used for communication from a mating console with suitable keyboard for entering desired tones, or tones with associated durations.

Advantageous for certain applications previously mentioned, but not necessary to all embodiments of my invention, is the analog-to-digital converter 46, which receives power along leads 27 and 45 from the solar cell 22, and which produces a digital indication of the solar-cell power output at each time. This digital signal is impressed upon the voltage-level bus 47 for use by the microprocessor 26 in any of a variety of ways. More specifically, this signal is usable by the microprocessor 26 to determine whether the light level at the solar cell 22 is within a particular range of values, and/or whether it is increasing or decreasing—over selected intervals such as one to fifteen minutes.

In this way the operation of the microprocessor may be inhibited by the logic programmed within the microprocessor itself when the behavior of the incident light does not satisfy particular criteria. As described earlier, such criteria as well as the tune or other sounds to be emitted are advantageously coordinated with the theme represented by the shape of the body (if any) of the ornament.

In testing prototypes of my invention I have found somewhat surprisingly that there is a range of light levels in which the solar cell generates adequate voltage for operation of the electronic circuit and the speaker to produce some sounds, but not for proper operation of the circuit and speaker to produce the preestablished, intended sounds. The result of operation in this range is to produce rather unpleasant, erratic sounds—more specifically, a grossly distorted verson of the intended sounds.

It appears that this behavior is due to erratic or inconsistent operation of the oscillator in the circuit. Apparently the oscillator may skip pulses, or produce pulses of reduced amplitude which are not picked up by the next downstream stages. It seems that there are consequently gaps in the sequence of notes, or notes of incorrect duration, or both. While I am not certain of the precise mechanisms by which the sounds are grossly distorted, I have found a way to prevent this undesirable result.

Figure 5:
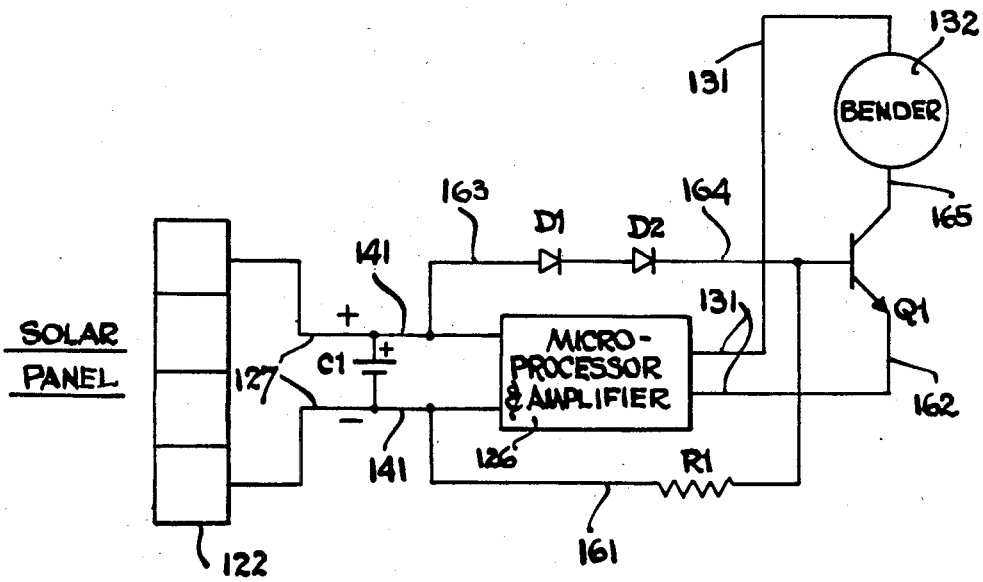
FIG. 5 is a schematic of a preferred embodiment that shuts off the speaker in inadequate light, and amplitude modulates it otherwise.

My solution is to suppress operation of the speaker when the voltage from the solar cell is not positively adequate for proper operation of the electronic circuit. FIG. 5 shows such an arrangement. The microprocessor, amplifier, and R. O. M. discussed earlier are within the block 126 labelled "microprocessor & amplifier." The acoustic driver is identified as a "bender" 132, and solar cell or cells here appear as a "solar panel" 122.

Voltage on the output leads 127 of the solar panel 122 is filtered by the capacitor C1, in combination with the internal impedance of the solar panel 122. The result is a somewhat more stable supply voltage at the input leads 141 to the microprocessor & amplifier 126. This added stability is particularly helpful for purposes of the "suppressing means" circuit which will now be described.

The voltage at the power leads 141 is tapped off as at 163 and through two series diodes D1 and D2 to the control lead 164 at the base of the transistor Q1. The threshold voltage required by the diodes D1 and D2 in effect is subtracted from the supply voltage at 163, in constructing the voltage on the control lead 164. This threshold voltage has been selected as slightly larger than the voltage required by the microprocessor & amplifier block 126 for entirely correct operation—that is to say, with no erratic operation such as skipping of pulses.

Until the supply voltage exceeds the threshold voltage required by the two diodes D1 and D2, no current is available at the base of the transistor Q1 to switch on the transistor. Since the transistor Q1 is in series with the "bender" 132, the bender is shut off until the microprocessor & amplifier 126 are fully up and running.

A resistor R1 is attached between the power return lead as at 161 and the transistor base as at 162. This resistor holds down the voltage on the base to achieve a positive, definite, stable crossover of the turn-on characteristic of the transistor.

Once the turn-on point has been passed, the transistor conducts generally proportionally to the excess of the supply voltage over the diode threshold voltage. Thus the volume of sound increases generally with the supply voltage, and hence with the light level at the solar cell.

The capacitor C1 may be a 22-microfarad, 6-volt unit. The resistor R1 may be a 10-kilohm resistor. The transistor Q1 and the diodes D1 and D2 may be of the types commonly available under the commercial component designators 4123 and 1N914 respectively.

It is desirable to be able to switch the music off without removing the novelty item entirely from its decorative position, and it is also desirable to be able to adjust the volume of the sound. It would be generally prohibitive, however, to provide an electrical switch. It would be even more problematical to provide an electrical volume control. Both switching and electrical volume controls could also introduce problems in maintaining the working module watertight, which is important for many potential outdoor and other applications of the invention.

Figure 6:
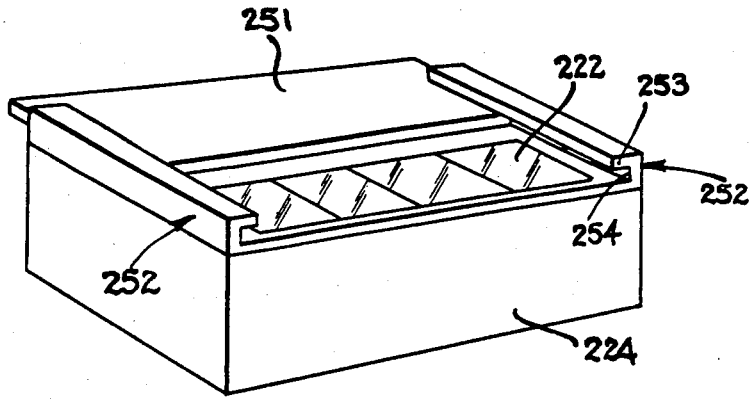
FIG. 6 is a perspective view of an embodiment with an adjustable shield to control the light at the solar cell.

I have found, however, that on-off switching can be obtained without an electrical switch, by adding a movable cover that can be positioned to shield the solar panel from incident light, and that can be positioned to expose the panel. The cover can pivot into position, or as shown in FIG. 6 it can slide into position. Appearing in FIG. 6 is a working module with a rectangular case 224, and solar panel 222 in a broad face of the case 224.

Affixed to or integral with that broad face is a retaining extension 252, shaped to form two opposed flanges 253 and under each flange 253 a slot 254. A shallow rectangular cover 251 slides under the retaining flanges 253 and within the slots 254. The cover 251 is narrow enough, in the direction parallel to the sliding motion, that it can be positioned to entirely expose the solar panel 222 without extending past the edge of the case 224. The cover 251 is wide enough, in that same direction, that it can be positioned to entirely cover the solar panel 222.

When in the latter position the cover 251 shuts off the power to the circuit and speaker, and thus effectually shuts off the music or other sounds. When positioned to expose the solar panel 222, the cover 251 allows power to flow to the circuit and speaker, if there is sufficient light to energize the solar panel.

Furthermore, if the working module is equipped with a "suppressing means" circuit such as illustrated in FIG. 5, the cover 251 will interact with that circuit to provide a volume control for the music or other sounds. When the cover 251 is positioned to provide enough light to properly operate the microprocessor & simplify 126 (FIG. 5), the transistor Q1 will be conductive and will allow the bender 132 to operate. As long as that condition is maintained, adjustments of the cover will control the degree of conduction of the transistor Q1 and hence the volume of the sound produced by the bender 132.

Figure 7:
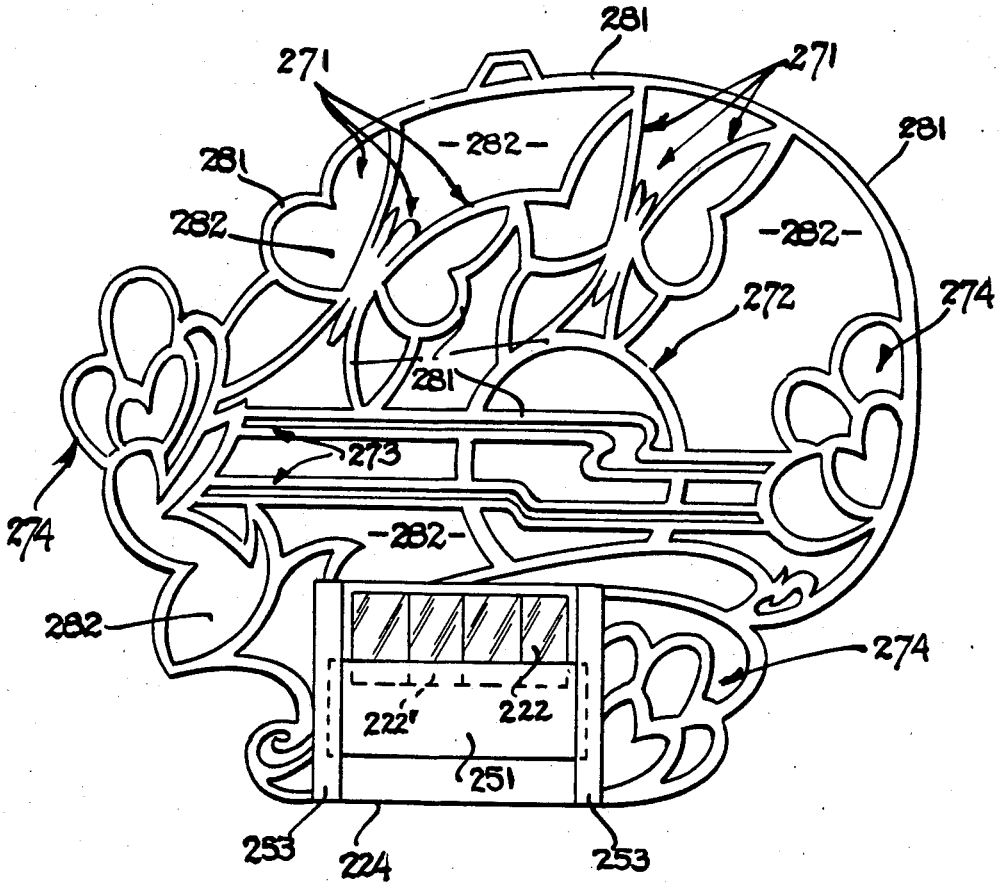
FIG. 7 is an elevation of another embodiment, incorporating the FIG. 6 module.

FIG. 7 shows another embodiment of my invention which may incorporate a working module such as that of FIG. 6. The FIG. 7 embodiment is an essentially two-dimensional open framework 281 cast in plastic, ceramic, or metal. Between the shaped members 281 of the framework are complementarily shaped open spaces 282. The shapes defined by the members 281 of the framework and the open spaces 282 are made to resemble familiar objects such as butterflies 271, a sun 272, and haze or a hazy horizon 273.

Mounted in the bottom of this framework 281 is the working module 224, with its solar panel 222. The cover 251 is mounted to slide, as in FIG. 6, below retaining flanges 253. Here the cover 251 is shown in a position which exposes one part 222 of the solar panel—and covers another part 222' of the solar panel so as to reduce the sound level as previously explained.

It is to be understood that all of the foregoing detailed descriptions are by way of example only, and not to be taken as limiting the scope of the invention—which is expressed only in the appended claims.

I claim:

1. A working module for an inexpensive ornament or a give-away novelty or the like which emits tunes or other sounds; said module comprising:

a solid-state digital electronic circuit, preprogrammed at manufacture to generate exclusively a series of electronic oscillations, preestablished at manufacture, corresponding directly to a tune or other series of sounds preestablished at manufacture;

a small speaker mounted to the chassis and connected to receive exclusively the preprogrammed electronic oscillations from the circuit and to emit the corresponding preestablished tune or other sounds for the exclusively unilateral entertainment or information of nearby people;

said preprogrammed oscillations being directed exclusively to the speaker, through amplification and control circuitry; and a solar cell mounted to the chassis and connected to power the circuit when exposed to light, so as to provide unattended operation essentially indefinitely;

the circuit being further preprogrammed to emit the particular tune or particular other sounds only when the dynamic behavior of light incident on the solar cell as a function of time satisfies corresponding particular criteria; and the circuit being further preprogrammed to suppress emission of the particular tune or other sounds even when sufficient light is available to power the circuit and speaker, if the dynamic behavior of incident light does not satisfy said criteria.

2. The working module of claim 1 wherein:

the criteria are readily recognizable as distinctly associated with said particular topic or subject matter.

3. A working module for an inexpensive ornament or a give-away novelty or the like which emits tunes or other sounds; said module comprising:

a solid-state digital electronic circuit, preprogrammed at manufacture to generate exclusively a series of electronic oscillations, preestablished at manufacture, corresponding directly to a tune or other series of sounds preestablished at manufacture;

a small speaker mounted to the chassis and connected to receive exclusively the preprogrammed electronic oscillations from the circuit and to emit the corresponding preestablished tune or other sounds for the exclusively unilateral entertainment or information of nearby people;

said preprogrammed oscillations being directed exclusively to the speaker, through amplification and control circuitry; and a solar cell mounted to the chassis and connected to power the circuit when exposed to light, so as to provide unattended operation essentially indefinitely;

wherein the tune or other sounds are readily recognizable as a particular familiar piece of music that is distinctly associated with a particular topic or subject matter; and in combination with a body that is firmly secured to or integral with the chassis, and which body has a shape that is readily recognizable as distinctly associated with said particular topic or subject matter;

the circuit being further preprogrammed to emit the particular tune or particular other sounds only when the dynamic behavior of light incident on the solar cell as a function of time satisfies corresponding particular criteria; and the circuit being further preprogrammed to suppress emission of the particular tune or other sounds even when sufficient light is available to power the circuit and speaker, if the dynamic behavior of incident light does not satisfy said criteria.

4. The working module of claim 3, wherein:

the criteria are readily recognizable as distinctly associated with said particular topic or subject matter.

5. A working module for an inexpensive ornament or a give-away novelty or the like which emits tunes or other sounds; said module comprising:

a solid-state digital electronic circuit, preprogrammed at manufacture to generate exclusively a series of electronic oscillations, preestablished at manufacture, corresponding directly to a tune or other series of sounds preestablished at manufacture;

a small speaker mounted to the chassis and connected to receive exclusively the preprogrammed electronic oscillations from the circuit and to emit the corresponding preestablished tune or other sounds for the exclusively unilateral entertainment or information of nearby people;

said preprogammed oscillations being directed exclusively to the speaker, through amplification and control circuitry; and a solar cell mounted to the chassis and connected to power the circuit when exposed to light, so as to provide unattended operation essentially indefinitely;

the electronic circuit, the speaker, and the solar cell being capable of operation to produce some sounds even when the light reaching the solar cell does not produce adequate voltage for correct operation to produce said preestablished tune or other sounds; and the module further comprising means for suppressing operation of the speaker when the light reaching the solar cell produces adequate voltage for some sounds but does not produce adequate voltage for correct operation to produce said preestablished tune or other sounds.

6. The working module of claim 5, wherein:

when the suppressing means are not suppressing operation of the speaker, the suppressing means control the speaker so that the volume of sound produced by the speaker varies generally with the voltage produced by the solar cell.

7. The working module of claim 5, wherein:

the suppressing means comprise a transistor in series with the speaker and controlled by the voltage from the solar cell, said transistor acting as a switch to prevent significant conduction through the speaker when the voltage from the solar cell is less than a particular value.

8. The working module of claim 6, wherein:

the suppressing means comprise a transistor in series with the speaker and controlled by the voltage from the solar cell, said transistor:

acting as a switch to prevent significant conduction through the speaker when the voltage from the solar cell is less than a particular value, and acting as an amplitude modulator to increase the current through the speaker with the voltage from the solar cell, when the voltage from the solar cell is greater than the particular value.

9. The working module of claim 8, wherein:

the suppressing means further comprise means for subtracting a generally fixed voltage from the voltage generated by the solar cell to produce a difference voltage for controlling the transistor; and means for applying the difference voltage to the control terminal of the transistor.

10. The working module of claim 6, further comprising:

mechanical means for shielding a manually variable fraction of the solar cell from incident light, to control the suppressing means and the volume of sound produced by the speaker.

11. The working module of claim 10, wherein the mechanical means comprise a cover that is manually movable into any of a range of positions so as to cover all of the solar cell sensitive surface, or none of the solar cell sensitive surface, or substantially any fraction of the solar cell sensitive surface between all and none;

whereby manual moving of the cover to cover substantially all of the solar cell sensitive surface acts as a switch to substantially turn off the speaker, and manual moving of the cover to uncover various substantial but variable fractions of the solar cell sensitive surface acts as an amplitude modulator to generally vary the sound level from the speaker with the amount of surface that is uncovered, when the voltage from the solar cell is greater than the particular value.

12. The working module of claim 11:

in combination with a decorative article depicting a sun near a horizon, together with butterflies; and wherein the working module is preprogammed to emit a cheerful morning song when the voltage from the solar cell is greater than the particular value.

13. The working module of claim 7, wherein:

the suppressing means further comprise means for subtracting a generally fixed voltage from the voltage generated by the solar cell to produce a difference voltage for controlling the transistor; and means for applying the difference voltage to the control terminal of the transistor.

* * * * *